US012710236B2

(12) United States Patent
Flahaut et al.

(10) Patent No.: US 12,710,236 B2
(45) Date of Patent: Aug. 18, 2026

(54) INTERNALLY PROFILED TUBES

(71) Applicant: Paralloy Limited, Billingham (GB)

(72) Inventors: Dominique Flahaut, Billingham (GB); Robert Lewis, Brackley (GB)

(73) Assignee: Paralloy Limited, Billingham (GB)

( * ) Notice: Subject to any disclaimer, the term of this patent is extended or adjusted under 35 U.S.C. 154(b) by 647 days.

(21) Appl. No.: 17/783,989

(22) PCT Filed: Nov. 23, 2020

(86) PCT No.: PCT/GB2020/052981

§ 371 (c)(1),
(2) Date: Jun. 9, 2022

(87) PCT Pub. No.: WO2021/116656

PCT Pub. Date: Jun. 17, 2021

(65) Prior Publication Data

US 2023/0019344 A1 Jan. 19, 2023

(30) Foreign Application Priority Data

Dec. 9, 2019 (GB) ..... 1917960

(51) Int. Cl.
*F28F 1/40* (2006.01)
*C10G 9/20* (2006.01)
*F28F 13/12* (2006.01)

(52) U.S. Cl.
CPC ..... *F28F 1/40* (2013.01); *C10G 9/203* (2013.01); *C10G 2300/1037* (2013.01); *C10G 2400/20* (2013.01); *F28F 13/12* (2013.01)

(58) Field of Classification Search
CPC ..... F28F 1/40
See application file for complete search history.

(56) References Cited

U.S. PATENT DOCUMENTS

| | | | | |
|---|---|---|---|---|
| 3,088,494 | A | 5/1963 | Koch et al. | |
| 3,847,212 | A | 11/1974 | Withers, Jr. et al. | |
| 4,314,587 | A * | 2/1982 | Hackett | F16L 9/02 165/184 |
| 5,950,718 | A | 9/1999 | Sugitani et al. | |
| 7,799,963 | B2 | 9/2010 | Inui et al. | |
| 2005/0131263 | A1 | 6/2005 | Wolpert et al. | |
| 2006/0102327 | A1* | 5/2006 | Inui | F28F 1/40 165/184 |
| 2008/0236803 | A1 | 10/2008 | Cao et al. | |
| 2010/0143206 | A1 | 6/2010 | Hashimoto | |
| 2013/0095443 | A1 | 4/2013 | He et al. | |
| 2015/0362174 | A1 | 12/2015 | Sung | |

FOREIGN PATENT DOCUMENTS

| | | | |
|---|---|---|---|
| CN | 100386586 | C | 5/2008 |
| CN | 101824333 | B | 1/2013 |
| DE | 102008053847 | A1 | 5/2010 |
| EP | 1561795 | A1 | 8/2005 |
| EP | 2248581 | A1 | 11/2010 |
| GB | 2570005 | A | 7/2019 |
| JP | S60185094 | A | 9/1985 |
| JP | H09217068 | A | 8/1997 |
| JP | H09241781 | A | 9/1997 |
| JP | H11199876 | A | 7/1999 |
| JP | 2002107081 | A | 4/2002 |
| JP | 2009243783 | A | 10/2009 |
| JP | 6109392 | B1 | 4/2017 |
| KR | 20050084873 | A | 8/2005 |
| SU | 1368611 | A1 | 1/1988 |
| WO | 2004015029 | A1 | 2/2004 |
| WO | 2007104952 | A2 | 9/2007 |
| WO | 2015114015 | A1 | 8/2015 |
| WO | 2016023776 | A1 | 2/2016 |
| WO | 2016099738 | A1 | 6/2016 |
| WO | 2018002330 | A1 | 1/2018 |

OTHER PUBLICATIONS

Office Action from counterpart Canada Application No. 3161276 dated Mar. 12, 2024, 5 pp.
Rule 114(2) from counterpart EP Application No. 20815908.7 dated Apr. 4, 2023. 4 pp.
International Search Report and Written Opinion of International Application No. PCT/GB2020/052981, mailed Dec. 17, 2020, 10 pp.
International Preliminary Report on Patentability from International Application No. PCT/GB2020/052981 dated May 17, 2022, 6 pp.
Search Report from counterpart GB Application No. 1917960.5 dated May 15, 2020, 4 pp.
Notice of Intent to Grant from counterpart British Application No. 1917960.5 dated May 31, 2023, 2 pp.
Response to Examination Report dated Mar. 2, 2023, from counterpart British Application No. 1917960.5, filed Mar. 22, 2023, 8 pp.
Office Action, and translation thereof, from counterpart Korean Application No. 10-2022-7022107 dated Jun. 12, 2024, 8 pp.
Examination Report from counterpart British Application No. 1917960.5 dated Mar. 2, 2023, 4 pp.
Office Action from counterpart Saudi Arabia Application No. 522432937 dated Jan. 4, 2023, 5 pp.

* cited by examiner

*Primary Examiner* — Randy Boyer
(74) *Attorney, Agent, or Firm* — Shumaker & Sieffert, P.A.

(57) ABSTRACT

The present invention relates to internally profiled variable pitch tubes or pipes made of steel. The terms tube and pipe are used synonymously in the context of this invention. These tubes are used in the petrochemical industry to crack oil, gas and shale feedstocks into simple hydrocarbons such as ethylene and similar products.

14 Claims, 5 Drawing Sheets

INTERNALLY PROFILED TUBES

This application is a national stage application under 35 U.S.C. § 371 of PCT Application No. PCT/GB2020/052981, filed 23 Nov. 2020, which claims the benefit of Great Britain Application No. 1917960.5, filed 9 Dec. 2019. The entire contents of each of PCT/GB2020/052981 and Great Britain Application No. 1917960.5 are incorporated herein by reference in their respective entireties.

The present invention relates to internally profiled variable pitch tubes or pipes made of steel. The terms tube and pipe are used synonymously in the context of this invention. These tubes are used in the petrochemical industry to crack oil, gas and shale feedstocks into simple hydrocarbons such as ethylene and similar products.

BACKGROUND

A considerable function of the petrochemical industry is to produce simple hydrocarbons such as ethylene and similar products through the process of 'cracking' oil, gas and shale feedstocks. These hydrocarbon products are in turn the starting materials for a wide range of chemicals used in the chemical industry, particularly as starting materials in the plastics industry.

The feedstock is cracked by heating to very high temperature inside steel tubes. The thermal cracking reaction may be facilitated by introducing the hydrocarbon feedstock i.e. the oil, gas or shale feedstock into the cracking tube along with steam. The gases pass through the steel tubes at high velocity. Reactors of this type are frequently known as ethylene crackers.

Ethylene steam cracker furnaces are widely used in the petrochemical industry for the conversion of the feed fluid to desired products via thermal cracking. The furnace is made mainly of coils/tubes which act as a heater for the fluid passing through them. Heat transfer to the fluid from the furnace/coils/tubes enables the cracking of the fluid passing within to produce the desired cracked products.

The tube walls are externally heated, usually using a furnace, and are normally heated above 900° C. The steel tubes conduct the heat to the fluid passing within them and more specially to the fluid in contact with the internal wall of the tubes. This means that there is a temperature gradient within the fluid passing along i.e. through the tubes. The consequence of this is that the fluid in contact with the internal wall of the tube is hotter than the fluid in the centre of the tube. This temperature gradient can create problems in terms of both cracking efficiency and the production of unwanted side products.

With regards to the productivity of the cracking process as a whole, a temperature gradient within the tubes means that the cracking reaction is not necessarily completed in the centre of the tube, whereas near the tube wall the conversion may progress to completion. Consequently, the overall conversion of the fluid into desired products such as ethylene or propylene isn't as high as it might be if the temperature gradient did not exist.

Another problem is that conversion near the wall may progress beyond completion and result in side products. Over a period of time, the pipes may become subject to fouling with coke and other deposits due to the uneven heating. In some cases, there is also a temperature gradient and consequently a concentration gradient of the products within the fluid along the length of the pipe due to variations in the temperature of the fluid.

Pipes used in thermal cracking processes are frequently more than simply hollow cylindrical tubes. Frequently such pipes are provided with internal protrusions, lugs or baffles in order to interrupt the fluid flow and to promote mixing. There are a number of different approaches to this but frequently the provision of such internal protrusions is complicated to manufacture. Some of these protrusions actually provide sites for the deposition and accumulation of coke and other solids as side products of the reaction.

CN 101824333 discloses one such cracking tube. The disclosed tube is not circular and has at least one internal protrusion that runs the entire length of the tube. Each protrusion is formed by an indentation of the wall of the tube, rather than being a fin or baffle protruding from the inner wall of the tube. The inner surface of the pipe is effectively continuous in the sense that it has not been modified by adding a fin or baffle in an axial direction along its internal wall. The cross-section of the wall itself is not symmetrical. The tube is formed of two sections, a first 'guide section' at the start of the tube, where the protrusion has a variable pitch, and an adjacent 'stabilisation section', where the protrusion has a constant pitch. The initial variable-pitch region has a gradual and continuous increase in pitch, ranging from 0-60 degrees.

EP1561795 describes cracking tubes for use in thermal reactors for producing ethylene. The pipes of this disclosure have fins formed on an inner surface which are inclined at a fixed angle with respect to an axis of the tube. This disclosure has discrete regions of fins, with each region having different fixed angles, and spaced apart along the axial length of the tube. These fins are intended for steering the fluid inside the tube. The fins are discretely arranged on one or more helical loci. The tube's inner surface also has regions where no fins are present in the direction parallel to the axis of the tube.

The present invention overcomes the disadvantages of established tubes by increasing the heat efficiency of the tube by ensuring substantially homogeneous mixing of the fluid. In the prior art, such as EP1561795, protrusions are welded on to the internal wall in the form of discontinuous fins with a helical shape. The disclosure of EP1561795 focusses on having one or several discontinuous helical-shaped welded profiles on the interior wall and is used in small internal diameter tube furnaces known as millisecond furnaces.

A key weakness of inventions aiming to increase the heat transfer in furnaces with such small internal diameter is that there may be the problem of a pressure drop along the length of the tube. The disclosure of EP1561795 aims to address the problem of heat transfer but this appears to be achieved at the expense of creating a pressure drop. Indeed, it appears that the heat transfer has been increased to the detriment of the pressure drop, with the internal fins being the origin of the excessive pressure drop along the length of the pipe.

In this regard, U.S. Pat. No. 5,950,718 also discloses a heat exchange tube for use in cracking furnaces. The disclosed tube has fins extending radially inward from the internal wall of the tube and aims to provide a balance between an improvement in heat transfer efficiency and suppression of pressure loss across the tube. The fin of the tube has a constant pitch that is specific to a particular region of the tube. For example, the tube may have a first region having a first constant pitch adjacent to a second region having a second constant pitch. The second constant pitch is different from the first constant pitch.

U.S. Pat. No. 4,314,587 discloses an internally ribbed tube for use in boilers. The tube comprises multiple internal ribs designed to minimise overheating of the tube by controlling the flow of fluid within the tube. The document also discusses the drawbacks of existing ribbed tubes, in particular that the shape of a rib may be 'advantageous in regard to pressure drop considerations'. This link between rib shape and 'pressure drop considerations' results in embodiments of the disclosure being provided with ribbing on only one side of the inner wall of the tube.

The present invention seeks to provide an improved steel pipe for use in cracking hydrocarbon feedstocks which overcome some or all of the disadvantages of the prior art. The pipes of the present invention are circular pipes. The walls are generally of uniform thickness. The cross-sectional profile of the walls is circular and fins are then added to the internal surface of the pipe, as discussed below.

One aim of the invention is to reduce or substantially eliminate the temperature gradient across the cross section of the pipe. The invention seeks to reduce the incidence of side products and also seeks to improve the overall efficiency of the process. The fins of the invention are designed to have a particular helical profile in an axial direction in order to secure this technical benefit.

BRIEF SUMMARY OF THE DISCLOSURE

The present invention, in contrast to the prior art, is able to maximise the heat transfer whilst also minimising pressure drop across the length of the tube. More particularly, the circular pipes of the invention tailors the maximum heat transfer to the tolerated pressure drop. The pipes or tubes of the invention are made of steel.

The invention achieves its objective by moving the fluid located near the tube walls of the ethylene cracker, where it is relatively very warm, toward the tube centre, where it is relatively cooler, by spinning (controlled centrifugation) in order to increase the fluid temperature in the centre of the tube. This is achieved using a carefully designed internal profile of the pipe. This internal profile is easy to manufacture.

The internal profile is continuous and is designed to increase the heating efficiency of the tube, and therefore increase the cracking efficiency of the furnace. In particular, the pipes of the invention are designed so that the cracking reaction is able to go to completion just before the pipe exits the furnace i.e. just before the end of the high temperature region so as to maximise production/yield of the desired products, ethylene and propylene.

This design also serves to minimise the production of the un-desired products, e.g. carbon, aromatics and soot deposits. It is also an aim of the invention to ensure that the pressure drop along the length of the pipe is minimised. In other words, the invention seeks to achieve an efficient heat transfer whilst also ensuring that the pressure along the pipe is maintained at the same level as far as possible.

In summary, the invention achieves its various objectives by forcing the hot fluid near the tube wall toward the centre of the tube to increase the overall fluid temperature.

According to the present invention, there is provided a steel tube for use in cracking hydrocarbons at high temperature, wherein the steel tube has a fin formed on the inner wall of the tube, the fin extending continuously in a helical direction across at least a portion of the axial length, the fin having a varying helical pitch.

In some embodiments, the fin runs across the entire axial length of the tube.

In some embodiments, the fin comprises an initial region of constant helical pitch. This initial region of constant helical pitch precedes the region of variable pitch. In one embodiment, there is only a single fin on the tube. In this case, the initial constant pitch fin is directly joined to the varying pitch fin so as to form a single continuous fin.

In other embodiments, the initial constant pitch fin may be separate from the fin of variable pitch. Thus, in some embodiments, the fin may comprise an initial region of constant helical pitch followed by a region of varying helical pitch.

In some embodiments, the fin comprises a final region of constant helical pitch. Thus, in some embodiments, the fin may comprise a region of varying helical pitch followed by a final region of constant helical pitch. The final constant pitch fin, when present, may be directly joined to the varying pitch fin so as to form a single continuous fin. In other embodiments it may be separated from the fin of variable pitch.

In some embodiments, the fin comprises an initial region of constant helical pitch, followed by a region of varying helical pitch, followed by a final region of constant helical pitch, as the tube is traversed from a first end to a second end of the tube. Accordingly, the fin may comprise a constant-variable-constant pitch arrangement.

In some embodiments, the initial region of constant helical pitch, when present, is between 1 D and 40 D in length (where D is the internal diameter of the tube), preferably between 1 D and 20 D in length, and more preferably between 2 D and 6 D in length.

In some embodiments, the final region of constant helical pitch, when present, is between 1 D and 40 D in length (where D is the internal diameter of the tube), preferably between 1 D and 20 D in length, and more preferably between 1 D and 3 D in length.

In some embodiments, the region of varying helical pitch has an axial length defined by the total length of the tube minus the lengths of the initial and final constant helical pitch regions, when present. In some embodiments, the region of variable pitch extends along the full length of the tube. Thus, in embodiments where the axial length of the initial and final regions of constant helical pitch is 0 D, the region of varying helical pitch runs along the full length of the tube.

In some embodiments, the sum of the axial lengths of the initial region of constant helical pitch, region of variable helical pitch and final region of constant helical pitch is equal to the total axial length of the tube.

In some embodiments, the region of variable helical pitch is a length that is at least 80% of the axial length of the tube. In some embodiments, the region of variable helical pitch is a length that is at least 50% of the axial length of the tube. In some embodiments, the region of variable helical pitch is a length that is at least 20% of the axial length of the tube.

In some embodiments, the region of variable helical pitch can be defined as a length that is up to and including 0.5 times the length of the tube. The region of variable helical pitch is always present in the tubes of the invention.

In some embodiments, the region of variable helical pitch can be defined as a length that is from 0.5 to 1.0 times the length of the tube. Not dependent on % claims Tubes according to the present invention may be considered to have a number of defining parameters. Firstly, there is the overall length of the tube which can be referred to as its axial length. Secondly, there is the cross-sectional shape of the tube. This represents the shape of the tube in profile when it is cut into two pieces. Thirdly, there is the helical length of the fin. The helical length refers to the length travelling along the fin itself as it rotates around the hypothetical central axis of the tube while making its way along the inner wall of the tube. Fourthly, it is also possible to define the height, width, and profile of the fin itself, which is provided on the inner wall of the tube.

In an embodiment, tubes according to the invention are linear. For example, the tube itself may not be helically shaped.

In an embodiment, the initial region of constant helical pitch is of lower i.e. shallower pitch than the final region of constant helical pitch. In an alternative embodiment, it is contemplated that the initial region of constant helical pitch is of higher pitch than the final region of constant helical pitch.

In an embodiment, the variation of pitch over the helical length of the region of varying helical pitch from its beginning to its end increases. This increase in pitch along its helical length may be constant or the increase in pitch may itself increase in magnitude along the helical length of this intermediate region. It is preferred that the increase in pitch is constant along the helical length in the region of varying helical pitch.

In an embodiment, the variation of pitch over the helical length of the region of varying helical pitch from its beginning to its end decreases. This decrease in pitch along its helical length may be constant or the decrease in pitch may itself decrease in magnitude along the helical length of this intermediate region. It is preferred that the decrease in pitch is constant along the helical length in the intermediate region.

In some embodiments, the overall change in helical pitch from the start of the tube to the end of the tube is greater than 0.2 D.

As mentioned previously, the fin may extend for the entire length of the tube or it may extend for just a portion of the axial length of the tube. Cracking tubes are typically manufactured in lengths of about 12 m and this appears to be an industry standard. The fin may extend for the entire 12 m of the tube or for only some part of that length. However, tubes can be manufactured in other lengths and the fin may extend over some or all of the axial length of such tubes. It should be appreciated that cracking tubes can be manufactured in any length as required by the conditions specific to each cracking furnace. Accordingly, the fin may extend across the entire axial length (e.g. about 6m, about 12m, about 13m) of the tube or for only some part of that axial length.

In some embodiments, when the tube has a length of about 12 m, the fin extends across a 6 m portion of the tube. Thus, in some embodiments, when the tube has a length of about 12 m, the fin extends across a 6 m portion of the tube that extends from a centre point along the axial length of the tube to one end of the tube.

In some embodiments, when the tube has a length of about 6 m, the fin extends across the full length of the tube. Thus, in some embodiments, when the tube has a length of about 6 m, the fin extends across the full axial length of the tube, i.e. from the first end of the tube to the second end of the tube.

Prior art tubes which are internally shaped or profiled generally have the shape or profile extending for the entire length of the tube and this can be costly to manufacture because of the complex techniques required to apply an internal shape or profile. In contrast, the tubes of the present invention can be provided with a fin along their entire axial length relatively economically.

The cross-sectional profile of the walls of the tubes of the invention are circular in shape. In principle, non-round cross section tubes could also be provided with an internal fin according to the invention. For example, off-round, elliptical, hexagonal, heptagonal, octagonal etc. tubes might also have a fin according to the invention provided and some or all of the inner wall.

One advantage of the invention is that the special shape of the fin means that it is not necessary for the entire axial length of the tube to provided with the fin. This also results in a significant cost saving without impacting performance in any way. It is also possible to provide shorter length tubes which are provided with helical fins along their entire axial length. For example, it is possible to produce a 6 m or 8 m or 10 m tube etc. which has a helical fin according to the invention along its entire axial length. Equally, such a tube may have a fin disposed along only a portion of its axial length.

In an embodiment, the fin extends only a portion of the axial length of the tube. In a preferred embodiment, the fin only extends along 80% of the axial length tube and more preferably only extends along 75% of the axial length. In further preferred embodiments, the fin only extends along 60% of the axial length and more preferably only along 50% of the axial length of the tube. However, the fin could extend as little as 40% of the axial length of the tube. In the case of a 12 m tube, we have found that the optimum length for the fin is about 6 m in terms of achieving the most efficient reaction conditions for the cracking reaction, meaning that the sweet-spot for the fin length is between 40% and 60%, inclusive, of the axial length of the tube. In other words, it appears as if a finned region of axial length of about 6m enables the best mixing of the hydrocarbon feedstock when passing through the tube.

It is contemplated that shorter or longer tubes than the normal standard of 12 m might be produced incorporating a variable helical pitch profile according to the invention over some or all of their axial length in order to achieve the same technical effect.

In another embodiment, the height of the fin is approximately constant along its length in an axial direction. In this context, height refers to the amount of protrusion of the fin from the surface of the inner wall of the tube. In another embodiment, the height of the fin may vary along its length. For example, the fin may have a certain constant or varying height over one portion of the helical length, and may have a different constant or varying height over another portion of the helical length the fin. These regions of differing height may or may not correspond with the regions of differing pitch of the fin. The height of the fin is comparable with the thickness of wall and may vary from 0.5 to 5 thicknesses, preferably from 1 to 2 thicknesses.

In another embodiment, the width of the fin is constant along its helical length. However, it is also possible that the width of the helical fin varies along its length in exactly the same manner as described for variations in the height of the helical fin along its length.

The most appropriate height and/or width of the fin will depend on the gas flow requirements for a particular end use application. These can be calculated as described below.

Tubes of the invention generally fall within the range of 6 m to 12 m in length. Tubes of the invention generally fall within the range of 20 mm to 70 mm in diameter, preferably within the range of 35 or 40 mm to 60 mm, more preferably within the range of 40 or 50 mm to 55 mm. Tubes according to the invention may have a diameter of 38 mm, 50 mm, or 65 mm. Tubes according to the invention are typically of 50 mm in diameter. Tubes according to the invention typically have a maximum diameter of 65 mm for best performance.

Where the diameter of a tube is referred to in this specification, this should be understood to be the internal diameter of that tube. In other words, the thickness of the wall of the tube does not form part of this measurement. Tubes of the invention typically have a wall thickness of from 6-12 mm. In particular, tubes of the invention may have a wall thickness of from 6-8 mm.

The profile i.e. the cross-section of the helical fin is typically semi-circular. However, other cross-sectional shapes are also possible, such as a rectangular, curved (round or rounded) shape, and elliptical shape, or a triangular shape. Again, the most appropriate shape for the cross-section of the fin will depend on the gas flow requirements for a particular end use application.

In another embodiment, the tube is provided with more than one fin according to the invention. In such a case, each fin may independently extend in a helical manner along all of the axial length of the tube or along only a portion. In some embodiments, two more fins may be of the same axial length. In this case, they may either extend over the same axial length of the tube or they may be arranged so as to extend over overlapping axial regions of the tube. In other embodiments, it is also possible for two or more fins to be of different lengths. In this case they may be arranged so as to substantially overlap one another along the entire length of the shorter fin, or they may be arranged so as to simply overlap over part of the length of the shorter fin.

In a further embodiment, when considering in terms of flow of hydrocarbon material through the tube when in use, it is possible to define one end of the tube as the start of the tube and the other end of the tube as the end of the tube. In such a case, one embodiment of the invention contemplates the beginning of the fin part way along the axial length of the tube away from the start of the tube. In this embodiment, the fin may terminate at the end of the tube, or it may terminate away from the end of the tube. It is preferred that the fin terminates at the end of the tube.

BRIEF DESCRIPTION OF THE DRAWINGS

Embodiments of the invention are further described hereinafter with reference to the accompanying drawings, in which.

DETAILED DESCRIPTION

Figure 1:
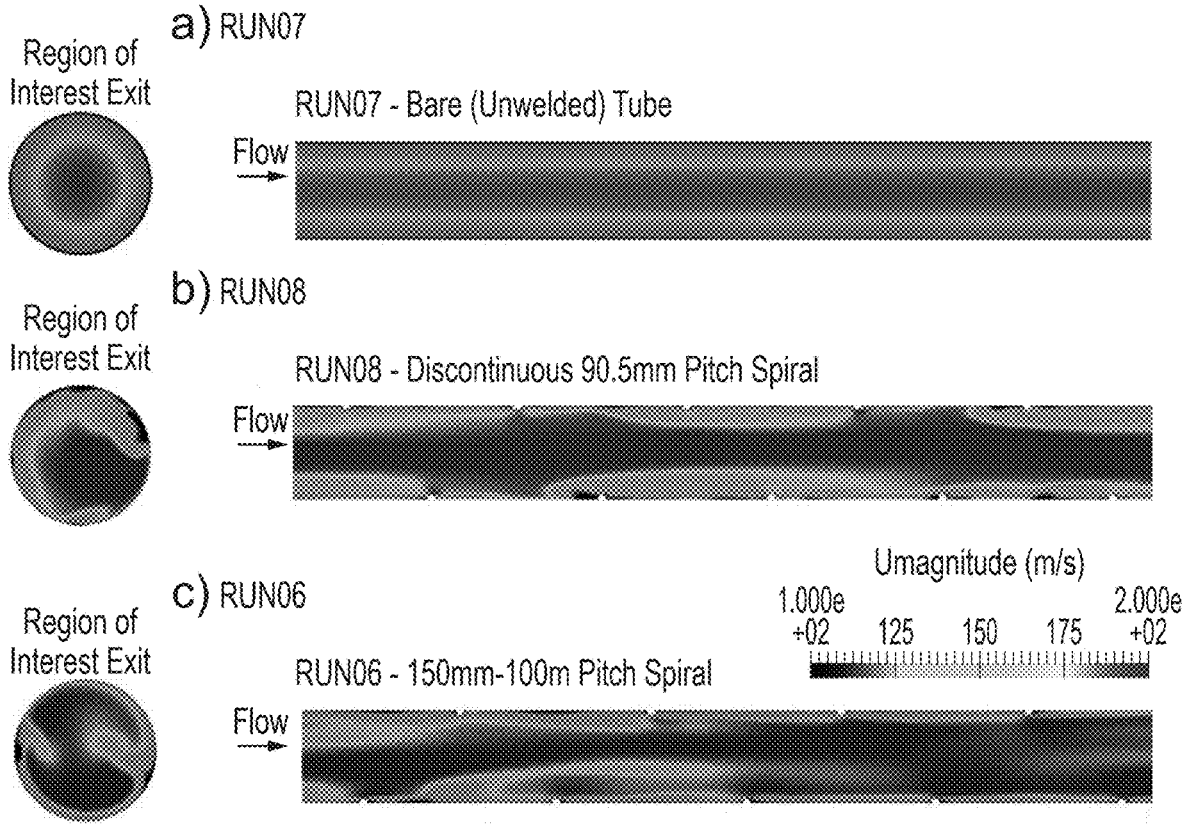
FIG. 1 demonstrates fluid flow through three tube designs, as modelled by the CFD software described herein: a) a bare tube, with no internal fin, b) a tube with a discontinuous/intermittent fin of constant pitch, and c) a tube according to the present invention, having a continuous fin of varying pitch.

The current invention is designed to achieve the maximum mixing of a fluid passing through a tube to facilitate an efficient chemical reaction. The tube comprises a continuous fin with a varied pitch helical shape, starting with a length or without a length of constant helical pitch at a defined initial pitch, and finishing with a length or without length of constant pitch at a defined final pitch. In other words, the initial and final regions of constant helical pitch are optional.

In the context of the present invention, a 'continuous' fin is a fin that extends from a first point to a second point without interruption. It may be that the first point is the first end of the tube and the second point is the second end of the tube.

We have found that there are four parameters of the tube which may be defined in order to calculate the appropriate region of variable helical pitch of the tube in order to maximise the efficiency of the cracking reaction while minimising pressure drop across the length of the tube. These are:

Fin pitch of the initial constant helical pitch region
Length of the initial constant helical pitch region
Fin pitch of the final constant helical pitch region
Length of the final constant helical pitch region These parameters were used by us to model the pressure and temperature of the fluid flowing through the tube. This was done using computational fluid dynamics (CFD) software as described below.

Accordingly, it will be appreciated that tubes according to the present invention have a region of varying helical fin pitch, wherein the length of the varying helical pitch region is a result of the lengths of the initial and final constant helical pitch regions.

The four parameters described above are determined such that the furnace outlet temperature is maximised and such that the pressure drop across the tube is minimised. Each of these parameters are defined for a tube having a specific tube length and with a specific internal diameter. The software enables optimum values to be determined from our realisation of the four key parameters.

For example. A tube having a 50 mm internal diameter (ID) and a tube length of 6m, the following four parameters may maximise the outlet temperature while minimising pressure drop:

| | |
|---|---|
| Fin pitch of the initial constant pitch region: | 100 mm |
| Length of the initial constant pitch region: | 1516 mm |
| Fin pitch of the final constant pitch region: | 128.57 mm |
| Length of the final constant pitch region: | 763 mm |

'Pitch' as described herein refers to the axial length along the tube required for one complete revolution of the helical fin. In other words, the pitch is the distance between equivalent points on two adjacent helical rotations of the fin, for example, between points A and B on FIG. 9. The reference to increasing pitch, or reducing pitch, means that the amount of curvature i.e. gradient of the fin increases or reduces respectively. A constant pitch fin has the same amount of curvature at any point on its length. Similarly, a varying pitch fin has a varying amount of curvature at different points along its axial direction. The fins are generally helical.

Tubes according to the present invention therefore aim to maximise the efficiency of heat transfer at a key location within the furnace and minimise as much as possible the pressure drop. Accordingly, the tubes of the present invention may apply to the full length of the entire furnace tube, but preferably to only a portion of the entire furnace tube length.

EXAMPLES

Example 1

Table 1 shows comparative data for simulations conducted for a series of tubes having an internal fin. The experiment calculated the outlet temperature and pressure drop across the tube for a hydrocarbon cracking reactor. The simulation study comprised four tubes, each with a 50 mm internal diameter and a total axial length of 6 m.

TABLE 1

| | RUN02 | RUN03 | RUN05 | RUN06 |
|---|---|---|---|---|
| Description | 200 mm Pitch | 100 mm Pitch | 200 mm-100 mm Varying Pitch | 150 mm-100 mm Varying Pitch |
| Constant Pitch Length | Full Tube | Full Tube | 10D at either end of ROI | None |
| Total Pressure Drop (barg) | 0.514 | 0.840 | 0.655 | 0.570 |
| Outlet Temperature (° C.) | 982.3 | 1003.9 | 983.9 | 993.5 |
| Heating Efficiency (° C./bar) | 199.2 | 147.5 | 158.5 | 199.2 |

RUN02 relates to a tube with a continuous internal fin having a constant 200 mm pitch across the entire length of the tube, i.e. not a tube according to the present invention. This configuration results in a low pressure drop (0.514 bar), but also a low outlet temperature at the furnace exit (982.3° C.).

RUN03 corresponds to a similar tube having a continuous internal fin with a constant pitch of 100 mm across the entire length of the tube, i.e. not a tube according to the present invention. This configuration results in a high outlet temperature at the furnace exit (1003.9° C.), but also a high pressure drop (0.840 bar).

RUN05 relates to a tube having an initial region of 200 mm constant pitch and final region of 100 mm constant pitch, each region corresponding to a length of 10 tube diameters. The tube of RUN05 also has a region of varying pitch positioned between the initial and final constant pitch regions. The pitch in the varying pitch region varies from 200 mm at the start of the varying pitch region to 100 mm at the end of the varying pitch region.

RUN06 corresponds to a tube having no constant pitch region, i.e. a tube in which the initial and final constant pitch regions each have a length of 0 D. Therefore, the tube comprises a region of varying pitch extending along the full length of the tube. The pitch varies from 150 mm at the start of the tube to 100 mm at the end of the tube.

RUN05 shows a noticeable increase in pressure drop (0.655 bar) and almost no temperature increase relative to RUN02. RUN06 shows a noticeable temperature increase at tube exit (993.5° C.), corresponding to a 10° C. increase relative to a tube having a continuous pitch of 200 mm (RUN02), with only a small increase in pressure drop (0.570 bar).

The simulations also studied the heating efficiency of each RUN. Table 1 shows that tubes having only a constant pitch region with a 200 mm pitch (RUN02) and tubes having only a variable pitch region with the pitch varying from 150 mm to 100 mm (RUN06) exhibit the best heating efficiency.

Example 2

A comparative study of the velocity of the fluid inside a 6m tube length with a 50 mm internal diameter was performed via the simulation methods described herein. The study compared a tube with no internal fin (RUN07) i.e. a 'reference tube', a tube with a discontinuous/intermittent fin of constant pitch such as those disclosed in EP1561795 (RUN08), and a tube comprising a region of varying helical pitch, wherein the pitch varies from 150 mm to 100 mm across the length of the tube, i.e. a tube according to the present invention (RUN06).

The study showed that a laminar fluid motion in the reference tube (RUN07), with the fluid in the centre moving faster than near the tube wall, as can be seen in FIG. 1*a*. This is typical and expected behaviour of fluid in a tube without an internal fin. Accordingly, the fluid in the centre of the tube is much cooler than near the tube wall. The tube comprising a discontinuous fin (RUN08) involves a fluid velocity much higher in the centre of the tube than the reference (RUN07), as can be seen in FIG. 1*b*. FIG. 1*b* also demonstrates that fluid flowing through the tube in RUN08 is bouncing on the discontinuous helical fin, with the warm fluid near the tube wall being redirected in several directions and creating turbulence towards the centre of the tube.

FIG. 1*c* demonstrates that a tube according to the present invention (RUN06), where continuous fin having a varying pitch, produces a fluid velocity in the centre of the tube that is much higher than reference tube (RUN07). However, in contrast to the tube comprising a discontinuous fin (RUN08), the higher fluid velocity is not only concentrated in the tube centre, but across the full internal area of the tube (tube wall to centre) by the time that the fluid has reached the second half of the tube.

FIG. 1*c* demonstrates that fluid passing through the second half of the tube section, is submitted to a centrifugal force with spinning turbulence orientated more in the axial direction of the tube. This creates less pressure drop relative to it the tube of RUN08, where the fluid bouncing creates turbulence resulting in a pressure drop across the tube. The results of this comparative study are summarised in Table 2.

TABLE 2

| | RUN06 | RUN07 | RUN08 |
|---|---|---|---|
| Description | 150 mm-100 mm Pitch Spiral | Bare (Unwelded) Tube | Discontinuous 90.5 mm Pitch Spiral |

TABLE 2-continued

| | RUN06 | RUN07 | RUN08 |
|---|---|---|---|
| Total Pressure Drop (barg) | 0.570 | 0.340 | 0.794 |
| Outlet Temperature (° C.) | 993.5 | 976.2 | 996.9 |
| Heating Efficiency (° C./bar) | 199.2 | 283.0 | 147.1 |

The average streamwise velocity and average in plane velocity of each tube was determined, as shown in Table 3. The average streamwise velocity is almost the same for each of the three tube designs. However, the average in-plane velocity of the tube of RUN07, which has no internal fin, is almost non-existent (0.13 m/s). Conversely, the tube of RUN08, which has a constant but discontinuous pitch, is significantly higher (33.85 m/s), however tubes according to the present invention, i.e. RUN06, demonstrate a drastically increased in-plane velocity (52.83 m/s). This is 18.43 m/s higher than the discontinuous design of RUN08. Therefore, tubes according to the present invention demonstrate an increase in the spinning/stirring/mixing of the gas within the tube. This allows a better distribution of the temperature across the entire contents of the tube and therefore a more efficient cracking reaction can occur.

TABLE 3

| | RUN06 | RUN07 | RUN08 |
|---|---|---|---|
| Description | 150 mm-100 mm Varied Pitch Spiral | Bare (Unwelded) Tube | Discontinuous 90.5 mm Pitch Spiral |
| Average streamwise velocity (Ux – m/s)) | 165.55 | 164.31 | 167.06 |
| Average in-plane velocity magnitude (Uy Uz – m/s) | 52.28 | 0.13 | 33.85 |
| Ratio of in-plane to streamwise velocity | 0.314 | 7.8E−5 | 0.203 |

Figure 2:
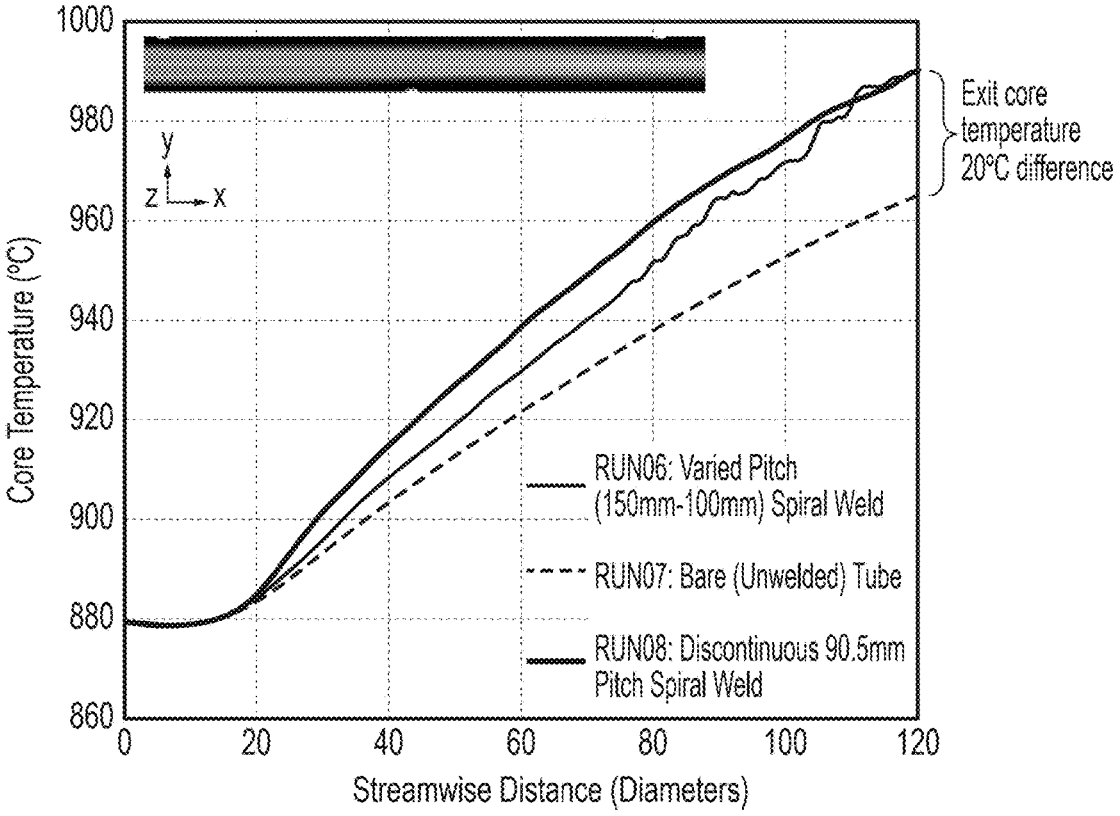
FIG. 2 charts the core temperature of gas flowing through the tubes of RUN06, RUN07, and RUN08 as a gas passes along the axial length of the tube.

FIG. 2 plots the distribution temperature along each of the tubes of RUN06, RUN07, and RUN08 at their core. FIG. 2 clearly shows that the core exit temperature of the tube of RUN07 (no fin) is over 20° C. lower than the core exit temperature of the tubes of RUN06 and RUN08. The temperature distribution pattern of the tube of RUN06 (i.e. a tube of the invention) falls between the temperature in the tubes of RUN07 and RUN08, until the last 500 mm of the tube, where the central temperature of RUN06 is slightly above that of RUN08. In this regard, one aim of the invention is to bring the fluid to its highest temperature just before exiting the tube to maximise cracking but to minimise secondary reactions due to long exposure at a cracking temperature, where formation of aromatics and soot decrease the yield of the desired cracked products, such as ethylene.

Figure 3:
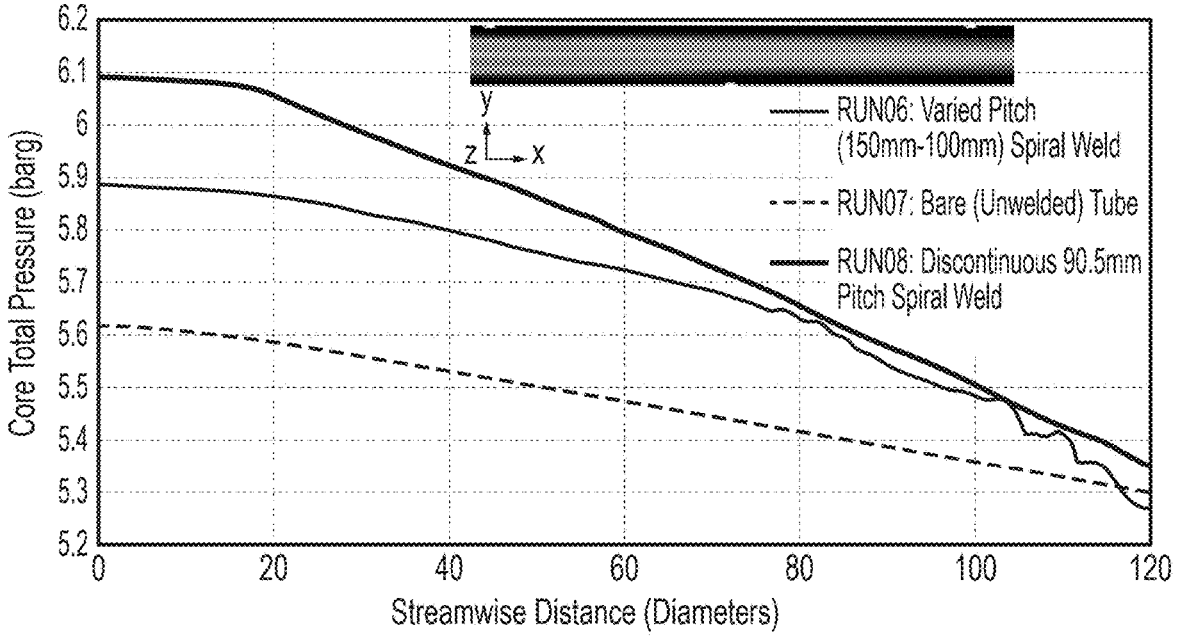
FIG. 3 charts the core pressure of a gas flowing through tubes of RUN06, RUN07, and RUN08 as a gas passes along the axial length of the tube.

Similarly, FIG. 3 shows that the starting pressure in the tube of RUN08 has to be much higher than for tubes of the invention (RUN06) in order to reach a similar exit pressure. Whilst the pressure drop is linear after 1000 mm up to the exit for the tubes of RUN07 and RUN08, this is not the case for the RUN06, where the pressure drops mostly in the last 1000 mm of the tube, where it is expected that the velocity will be much higher because of increased spinning/mixing of the gas, and where the temperature increase is the highest.

Another way to understand the temperature distribution of the gas across and along the tube length is to evaluate the volume of total gas reaching a given temperature or to evaluate the length of tube needed for the gas to reach a given temperature (slide 7). The chosen temperatures been 927° C., 955° C., 975° C., it was determined the portion of gas above these temperatures and the length of tube in which the gas need to travel to reach these temperatures. If the average exit temperature of the concurrent and the invention are nearly identical, the length of tube needed to a gas above 975° C. which is nearly the same than the exit temperature of the reference, is longer for the invention (104.5×internal diameter=5225 mm) than the competitor (98.3×internal diameter=4915 mm), which means that the extra nearly 20° C. increase temperature before tube exit are reach in a shorter distance and therefore with less secondary reactions. It can observe that the volume of fluid reaching the given temperature are below the competitor with 2%, 5% and finally 6%, but these results have to be considered with the pressure drop results. As if the volume is higher and as if the exit temperature of the invention is slightly lower than the competitor, in other hand, the pressure drop is much smaller (slide 08), so this means that the current invention is impressively efficient to heat the fluid (199.2° C./bar) than the concurrent (147.1° C./bar), with 52.1° C./bar more heating efficiency.

Invention Design Optimisation

The axial length of the initial and final regions of constant helical pitch determines the length of the region of varying helical pitch. The length of the region of varying helical pitch is the length of the tube that is remaining once the initial and final regions of constant helical pitch have been determined.

Therefore, it will be appreciated that in some embodiments where the initial and final regions of constant helical pitch are absent, the total axial length of the fin is the same as the axial length of the tube.

Example 3

A number of simulations were performed by the methods described herein, to determine the influence of each of the tube parameters on the pressure drop and gas outlet temperature. The results of these simulations are given in Table 4.

TABLE 4

| | Input Parameters | | | | Outputs | |
|---|---|---|---|---|---|---|
| Run | Initial Pitch | Final Pitch | Initial Length | Final Length | Pressure Drop (bar) | Outlet Temperature (C.) |
| 11 | 194.7 | 144.75 | 1579 | 1684 | 0.4256 | 985.98 |
| 12 | 247.4 | 55.25 | 526 | 421 | 0.5439 | 987.24 |
| 13 | 131.6 | 102.65 | 2000 | 1158 | 0.6393 | 996.86 |
| 14 | 110.5 | 134.2 | 421 | 842 | 0.6064 | 996.42 |
| 15 | 257.9 | 128.95 | 632 | 211 | 0.3917 | 983.14 |
| 16 | 278.9 | 118.4 | 1158 | 1895 | 0.4311 | 984.64 |
| 17 | 300 | 76.3 | 1263 | 947 | 0.4612 | 983.90 |
| 18 | 173.7 | 150 | 1474 | 526 | 0.4891 | 986.53 |
| 19 | 152.6 | 50 | 1368 | 632 | 0.8451 | 994.26 |
| 20 | 163.2 | 81.6 | 211 | 316 | 0.6594 | 990.98 |
| 21 | 226.3 | 86.85 | 1684 | 105 | 0.4732 | 984.42 |
| 22 | 100 | 113.15 | 947 | 1789 | 0.7098 | 999.79 |
| 23 | 205.3 | 71.05 | 1789 | 1579 | 0.6460 | 992.32 |
| 24 | 236.8 | 65.8 | 737 | 2000 | 0.7543 | 994.37 |
| 25 | 289.5 | 97.35 | 105 | 1053 | 0.4759 | 984.07 |
| 26 | 268.4 | 123.7 | 1895 | 737 | 0.4059 | 982.28 |
| 27 | 215.8 | 139.45 | 316 | 1263 | 0.4741 | 985.99 |
| 28 | 184.2 | 92.1 | 0 | 1368 | 0.6053 | 993.77 |
| 29 | 121.1 | 60.55 | 842 | 1474 | 0.9863 | 998.03 |
| 30 | 142.1 | 107.9 | 1053 | 0 | 0.5854 | 994.77 |
| 31 | 240.40 | 119.80 | 2000 | 470 | 0.3987 | 983.28 |

TABLE 4-continued

| | Input Parameters | | | | Outputs | |
|---|---|---|---|---|---|---|
| Run | Initial Pitch | Final Pitch | Initial Length | Final Length | Pressure Drop (bar) | Outlet Temperature (C.) |
| 32 | 174.50 | 127.80 | 2000 | 1056 | 0.4633 | 988.10 |
| 33 | 142.10 | 119.50 | 1685 | 980 | 0.5536 | 993.41 |
| 34 | 100.00 | 122.00 | 524 | 467 | 0.7033 | 1000.17 |

As evident from Table 4, the highest gas outlet temperature can be achieved with an initial pitch in the region of constant helical pitch that is smaller than the pitch in the final region of constant helical pitch (see RUN14, RUN22 and RUN34).

Accordingly, the axial length of the region final region of constant helical pitch has a greater impact on the pressure drop across the tube than the initial region of constant helical pitch. We have found that the longer the axial length of the region of constant helical pitch, the large the pressure drop across the tube. However, the increase of the axial length of the initial region of constant helical pitch on its own does not have a notable influence on the pressure drop. The initial region of constant helical pitch only appears to influence pressure drop when combined with an increasing axial length of the region of final constant helical pitch.

This means that relatively short, or non-existent, initial and final regions of constant helical pitch are most effective. We also found that the influence of the axial length of the initial and final constant pitches are similar on the gas exit/outlet temperature as on the pressure drop.

Methodology for Modelling Fluid Flow

To simulate the fluid flow inside tubes of the invention, computational fluid dynamics (CFD) software was used to solve a series of equations that describe how the fluid behaves within a given geometry and set of flow conditions.

The CFD solver used to determine the performance characteristics of each tube design is based on OpenFOAM (an open source CFD solver). However, there are several commercial CFD solvers available that would be capable of simulating the gas flow through the tube design and outputting pressure drop and gas exit temperature. For example, the CFD solver used to determine the characteristics of the tube may be ANSYS Fluent, ANSYS CFX, or Star CCM+.

The following assumptions are made when setting up the CFD model:

- The flow is compressible, unsteady, turbulent and single phase
- There are no significant geometric features directly upstream or downstream of the region of interest
- The tube wall is held at a fixed temperature
- The incoming flow enters at a fixed temperature
- The mass flow rate entering the tube is fixed
- The chemical reactions within the tube are not modelled.

The code used to determine the performance envelope for the design can be replicated using one of the following commercial optimisation codes:

- Mode Frontier (https://www.esteco.com/modefrontier)
- Noesis (https://www.noesissolutions.com/our-products/optimus/engineering-optimization)
- The type of optimisation used is an 'expensive objective function' and using meta-modelling methods (https://en.wikipedia.org/wiki/Metamodeling).
- The results are assessed with a response surface approach, in particular this uses a type of analysis known as kriging (https://en.wikipedia.org/wiki/Kriging).

We have undertaken a kriging process that takes a set of points that populate a design space, each of which consist of geometric parameters and desired outputs and fits a response surface to the input data. This response surface then gives a method for predicting how the outputs will respond to any change of the design within the limits of the input parameters. In the case of tubes of the present invention, each point in the design space consists of the following:

| | |
|---|---|
| Fin pitch of the initial region of constant helical pitch | Parametric Input |
| Fin pitch of the final region of constant helical pitch | Parametric Input |
| Axial length of the initial region of constant helical pitch | Parametric Input |
| Axial length of the final region of constant helical pitch | Parametric Input |
| Pressure Drop | Simulation Output |
| Outlet Temperature | Simulation Output |

Therefore, each output design point provides a predicted performance and the combination of the four design parameters that achieve it.

Figure 4:
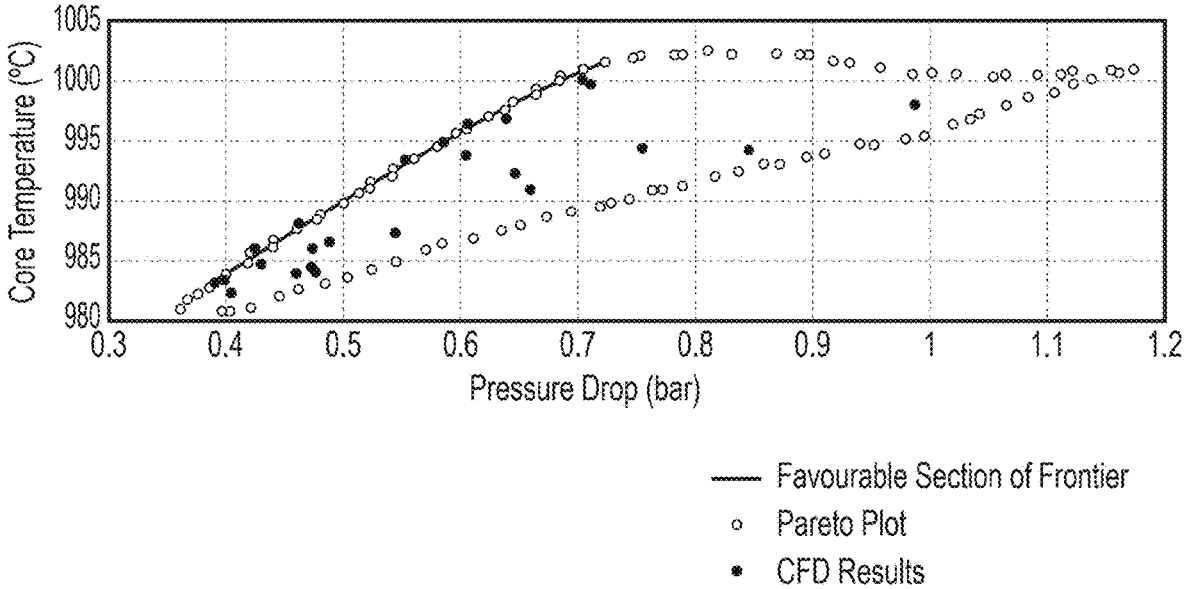
FIG. 4 depicts an example of a Pareto plot that results from the modelling experiments detailed herein.

The optimisation code produces a Pareto plot that defines the predicted limits of the design space, based on the input parameters. FIG. 4 shows an example of a Pareto plot. The red points are CFD simulation results that have been used in the optimisation code to predict the performance envelope (bounded by the blue points). In this example the green line shows the favourable frontier of the Pareto. Further details on the Pareto plot can be found on the following webpage: https://en.wikipedia.org/wiki/Multi-objective optimization.

Optimisation Procedure

Figure 5:
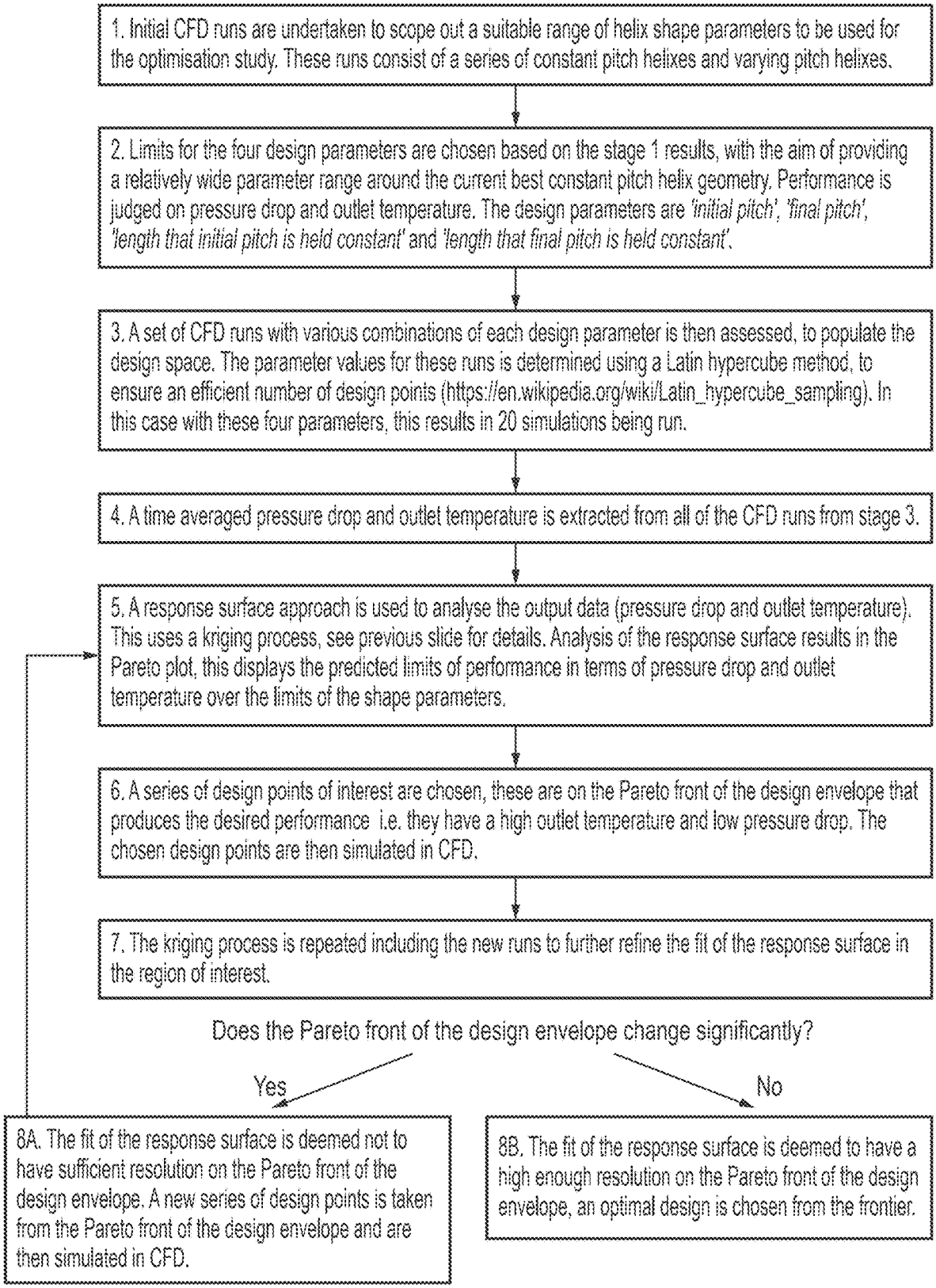
FIG. 5 is a flow diagram representing the method used to determine the optimal design parameters of tubes according to the present invention.

The method used to determine the optimal parameters of the tube is depicted in the flow diagram of FIG. 5.

In a first step, initial CFD runs are undertaken to scope out a suitable range of helix shape parameters to be used for the optimisation study. These runs consist of a series of tubes comprising a fin of constant pitch or varying pitch.

In a second step, limits for the four design parameters are chosen based on the stage 1 results, with the aim of providing a relatively wide parameter range around the current best constant pitch fin geometry. Performance is judged on pressure drop and outlet temperature. The design parameters are 'initial pitch', 'final pitch', 'length that initial pitch is held constant' and 'length that final pitch is held constant', as described herein.

In a third step, a set of CFD runs with various combinations of each design parameter is then assessed, to populate the design space. The parameter values for these runs is determined using a Latin hypercube method, to ensure an efficient number of design points (https://en.wikipedia.org/wiki/Latin_hypercube_sampling). In this case with these four parameters, this results in 20 simulations being run.

Subsequently, in a fourth step, a time averaged pressure drop and outlet temperature is extracted from all of the CFD runs from stage 3.

In a fifth step, a response surface approach is used to analyse the output data (pressure drop and outlet temperature). This uses a kriging process, as discussed elsewhere herein. Analysis of the response surface results in a Pareto plot, which displays the predicted limits of performance in terms of pressure drop and outlet temperature over the limits of the shape parameters.

In a sixth step, a series of design points of interest are chosen, these are on the Pareto front of the design envelope that produces the desired performance i.e. they have a high outlet temperature and low pressure drop. The chosen design points are then simulated in CFD.

In a seventh step, the kriging process is repeated including the new runs to further refine the fit of the response surface in the region of interest.

If the Pareto front of the design envelope changes significantly after the seventh step, then the fit of the response surface is deemed not to have sufficient resolution on the Pareto front of the design envelope. A new series of design points is taken from the Pareto front of the design envelope and are then simulated in CFD.

If the Pareto front of the design envelope does not change significantly, then the fit of the response surface is deemed to have a high enough resolution on the Pareto front of the design envelope, and an optimal design is chosen from the frontier.

Further Examples

Example 4

12m Length Tube—50 mm Inside Diameter:

Tubes according to the present invention may be 6m in length. However, conventional cracking furnaces comprise a cracking tube that is 12m in length. We have therefore investigated the present invention wherein the tube has an axial length of 12 m.

A comparative study between a 12m tube of the present invention (RUN36) and a 12m tube comprising a discontinuous fin of constant helical pitch (RUN37). The tube of RUN36 comprises a fin having a region of varying pitch, wherein the fin having a region of varying pitch extends across the final 6m portion of the tube. In other words, the tube of RUN36 has an initial 6m axial length in which there is no fin.

Figure 6:
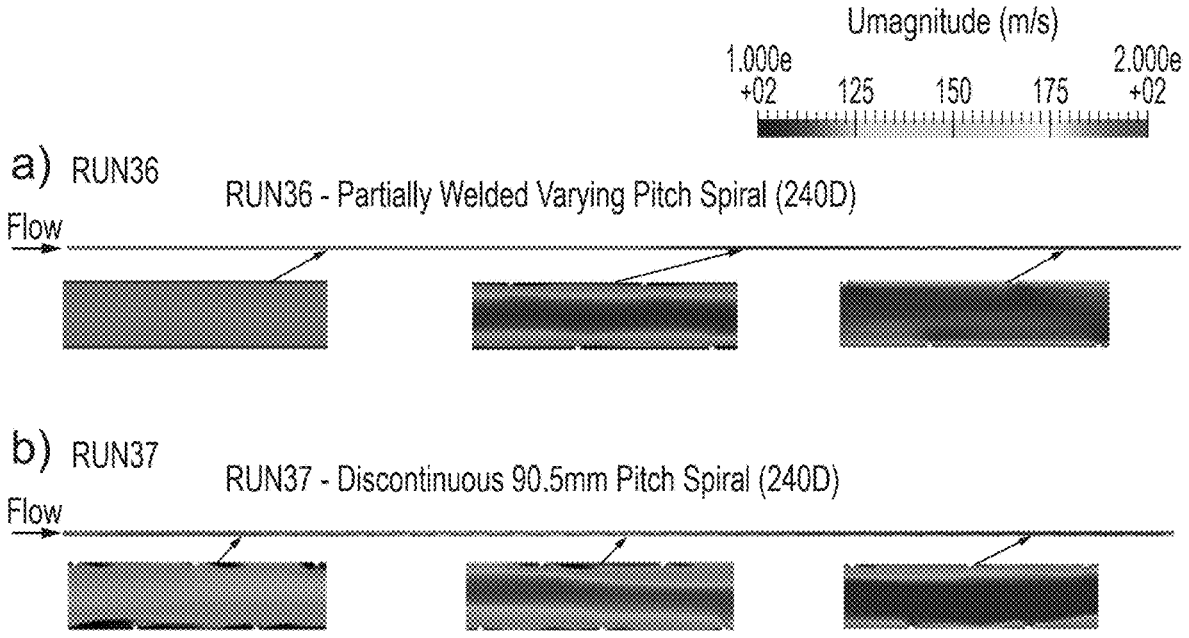
FIG. 6 demonstrates fluid flow through tubes according to RUN36 and RUN37.

FIG. 6 depicts the gas stream velocity profiles of the tubes of RUN36 (FIG. 6*a*) and RUN37 (FIG. 6*b*). It is clear from FIG. 6 that the gas velocity in the 12m tube of the invention is better distributed across and along the entire tube length when compared to the tube of RUN37. Accordingly, the tube of RUN36 will have an improved heating efficiency and less pressure drop compared to RUN37.

The summary of the gas stream velocity shown in Table 5 demonstrates that the average in-plane velocity of a 12m tube of the invention and that of a 12m tube comprising a discontinuous fin of constant pitch are very similar to the average in-plane velocity of the 6m tubes detailed in Table 3. Therefore, we have found that despite an initial finless 6m region in a 12m tube of the invention (compared to a 12m discontinuous fin in RUN37), a 12m tube of the invention still creates a higher in-plane velocity of the gas stream. Accordingly, a 12m tube of the invention having a 6m fin provides enhanced spinning/stirring/mixing of the gas within the tube.

TABLE 5

| | RUN36 | RUN37 |
|---|---|---|
| Description | Partially Welded 100 mm-128.6 m Pitch Spiral | Discontinuous 90.5 mm Pitch Spiral |
| Average streamwise velocity (Ux – m/s)) | 170.897 | 171.479 |
| Average in-plane velocity magnitude (Uy Uz – m/s) | 49.307 | 34.459 |
| Ratio of in-plane to streamwise velocity | 0.289 | 0.201 |

FIG. 6*a* shows that the core gas temperature in the tube of RUN 36 does not increase too early in the tube, but instead only begins to increase after around 8.46m (169.2×ID, where ID=50 mm). This prevents the gas from heating up and cracking too early, which in turn avoids the formation of unwanted secondary reactions.

We have found that the temperature distribution of the core gas between 8.0m (160×ID) and the tube exit at 12m (240×ID), is the most critical region of the tube for efficient cracking. It can be seen in FIG. 6*a* that the gas temperature increase is drastic in this region of tubes of the invention. In fact, in this short length of the tube of RUN36, the temperature increases to match the temperature of the tube of RUN37.

More specifically, the core gas temperature in the tube of RUN36 is at 988.5° C. at a point 8m along the tube, while the temperature of the tube of RUN37 is already 1007.35° C. by this point (i.e. 18.85° C. higher). Accordingly, the tube of RUN 37 is more likely to produce side products than the tube of RUN36. In addition, the core gas temperature in tubes of the invention is 1026.15° C. when it exits the tube, compared to a temperature of 1029.45° C. in the tubes of RUN37 (i.e. only 3.3° C. more than the invention). It follows that the targeted and more efficient mixing resulting from the tubes of the present invention give rise to a more efficient cracking reaction.

Figure 7:
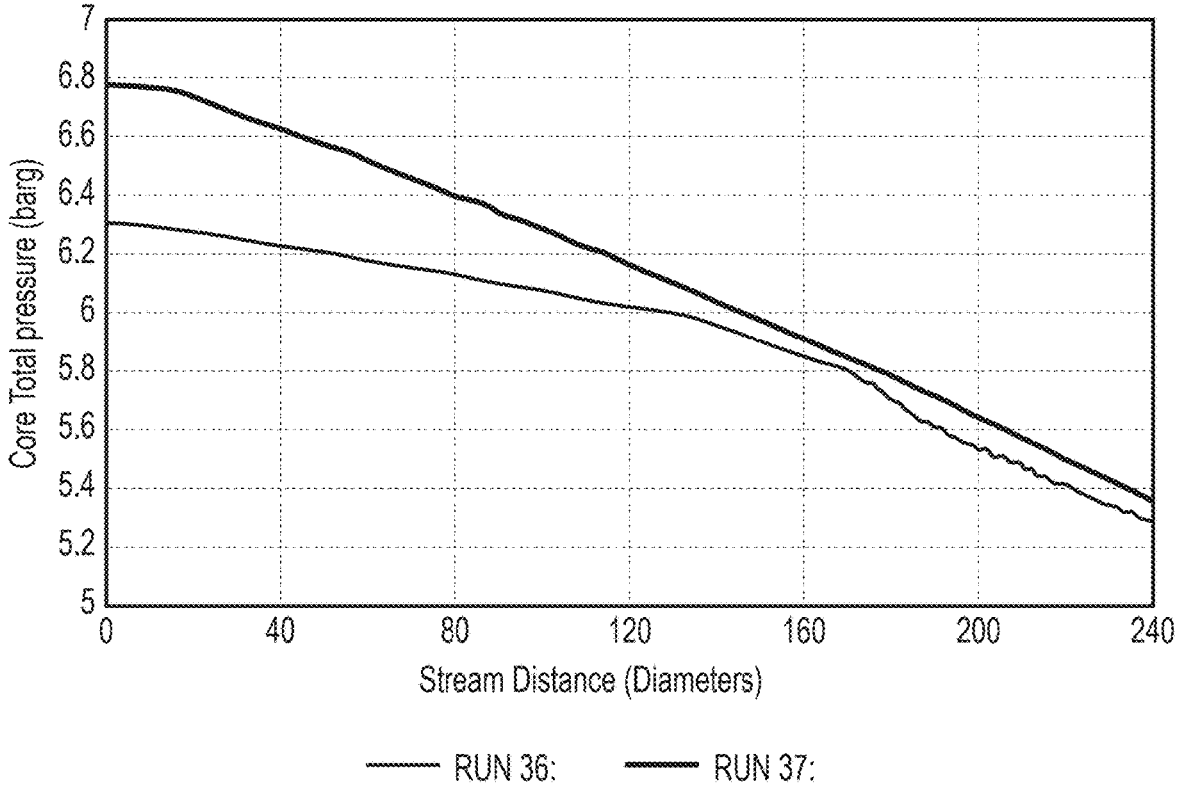
FIG. 7 charts the core pressure of a gas flowing through tubes of RUN36 and RUN37 as a gas passes along the axial length of the tube.

Furthermore, as can be seen from FIG. 7, the increased temperature of the gas at the outlet of the tube of RUN37 comes at a cost of increased pressure drop. Accordingly, the tube of RUN37 requires a higher starting gas core pressure (0.4 bar higher) than tubes according to the present invention.

Table 6 summarises the average gas pressure drop and the average exit/outlet gas temperature (note that this is the average gas temperature and pressure, not the core), shows that tubes having a fin present on the final 6m portion of a 12m tube is still more efficient tubes having a discontinuous fin of constant pitch across the full 12m length of a tube.

TABLE 6

| | RUN36 | RUN37 |
|---|---|---|
| Description | Partially Welded 100 mm-128.6 m Pitch Spiral | Discontinuous 90.5 mm Pitch Spiral |
| Total Pressure Drop (barg) | 1.000 | 1.480 |
| Outlet Temperature (° C.) | 1027.95 | 1031.99 |
| Heating Efficiency (° C./bar) | 147.89 | 102.70 |

We have found that the heating efficiency of tubes of RUN36 is around 45° C./bar (44%) higher than the tubes of RUN37. Therefore, even if tubes according to RUN37 demonstrate a slightly higher (around 4° C.) average exit gas temperature, the pressure drop is drastically lower (0.480 bar). This means that the pressure drop in tubes of the invention is nearly 50% less than the tubes of RUN37, which have a discontinuous fin of fixed pitch. Considering that a plain tube, without any internal fin, has a pressure drop of 0.764 bar, tubes according to the present invention exhibit a pressure drop increase of only 0.236 bar relative to a bare tube (a 31% increase). Conversely, tubes according to RUN37 exhibit a 94% increase pressure drop across the tube.

Example 5

13.26m Length—44 mm Inside Diameter:

The experiments of Example 4 were repeated for a tube having an axial length of 13.26m and an internal diameter of 44 mm. A tube with these dimensions closely resembles those used in millisecond ethylene steam cracker furnaces.

Figure 8:
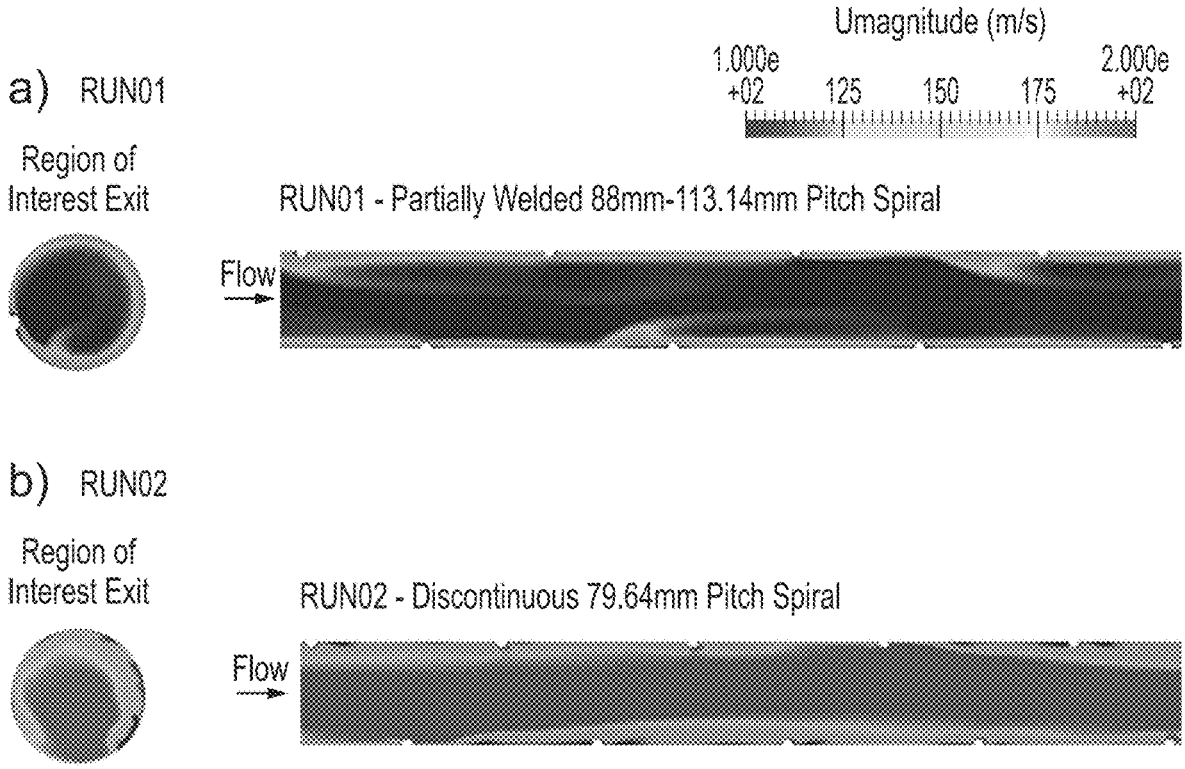
FIG. 8 demonstrates fluid flow through tubes according to RUN01 and RUN02.

FIG. 8 shows the gas velocity distribution for a tube according to the present invention (RUN01—FIG. 8*a*) and a 13.26m tube comprising a discontinuous fin of constant helical pitch (RUN02—FIG. 8*b*). The tube of RUN01 comprises a fin having a region of varying pitch, wherein the fin having a region of varying pitch extends across the final 6m portion of the tube. In other words, the tube of RUN36 has an initial 7.26m axial length in which there is no fin.

FIG. 8 shows that the tube according to the present invention exhibits a fast and homogeneously distributed gas flow, even very close of the tube wall. This is not the case for the tube of RUN02, where a thick layer near a large portion of the tube wall has a slower velocity. From this study and findings, it can expected that the pressure drop across tubes of the invention should be significantly lower than the tubes of RUN02.

Table 7 shows that the average in plane velocity of tubes according to the invention is 57.88 m/s compared to only 33.57 m/s for tubes according to RUN02 (i.e. a 24.31 m/s (72%) increase in velocity. Therefore, a 13.26m tube according to the invention provides enhanced spinning/stirring/mixing of the gas within the tube. The result is a tube that gives rise to fewer side products and a more efficient cracking reaction.

TABLE 7

| | RUN01 | RUN02 |
|---|---|---|
| Description | Partially Welded 88 mm-113.14 mm Pitch Spiral | Discontinuous 79.64 mm Pitch Spiral |
| Average streamwise velocity (Ux – m/s)) | 173.36 | 172.40 |
| Average in-plane velocity magnitude (Uy Uz – m/s) | 57.88 | 33.57 |
| Ratio of in-plane to streamwise velocity | 0.3339 | 0.1947 |

The Core Temperature distribution along the 13.26m is similar to the 12m tubes described in Example 4, and show the same drastic core temperature increase, in this case in the region from 7.7m (175×ID of 44 mm), and more from 8.8m (210×ID), with the difference between the exit core temperature of the RUN01 and RUN02 being smaller than for the 12m tubes described in Example 4 (only 1.3° C., compared to 3.3° C. for the 12m tubes).

Whilst the core gas exit temperature is nearly the same for RUN01 and RUN02, tubes of RUN02 need a starting gas core pressure that is even higher than the increased starting pressure required for the 12m/50 mm ID tubes of Example 4 (0.4 bar in Example 4, 0.662 bar in the present example). This represents a requirement of a 66% increase in starting pressure to achieve a similar core gas exit temperature.

Table 8 shows that the average gas pressure drop and the average exit/outlet gas temperature (note that average gas temperature and pressure, not the core) of the 13.26m tubes of the present invention are even more efficient. Tubes of the present invention (RUN01) are 34.88° C./bar more efficient that the tubes of RUN02. This is an efficiency increase of 46.4%.

TABLE 8

| | RUN01 | RUN02 |
|---|---|---|
| Description | Partially Welded 88 mm-113.14 mm Pitch Spiral | Discontinuous 79.64 mm Pitch Spiral |
| Total Pressure Drop (barg) | 1.41 | 2.09 |
| Outlet Temperature (° C.) | 1035.3 | 1037.1 |
| Heating Efficiency (° C./bar) | 110.13 | 75.25 |

Example 6

13.26m Length—44 mm Inside Diameter—Fin Region Extending Across the Full Axial Length of the Tube The above experiments were repeated to provide a comparison between a 13.26m tube having a discontinuous fin of fixed pitch (RUN02) and a tube according to the present invention where the fin also extends across the full axial length of the tube (RUN03).

We found that the velocity distribution for tubes according to RUN03 were slightly more turbulent near the tube exit when the fin is applied across the full length, compared to when the fin only extends across the final 6m axial region of the tube (RUN01), and still more homogeneous temperature distribution near the ID wall in comparison to the tubes of RUN02, which have a discontinuous fin of fixed helical pitch.

Table 9 shows that the average in the plane velocity of the tubes of RUN03 is 4.08 m/s lower (53.80 m/s) than the tubes of the invention having an equivalent fin across only the final 6m region of the tube (57.88 m/s). However, this in-plane velocity is still 20.23 m/s higher than the discontinuously finned tubes of RUN02 (33.57 m/s). This represents a 60.3% increase in velocity for the tubes of RUN03 over RUN02. Accordingly, tubes according to the present invention in RUN03 provide much higher mixing for a more efficient cracking reaction.

TABLE 9

| | RUN02 | RUN03 |
|---|---|---|
| Description | Discontinuous 79.64 mm Pitch Spiral | Fully Welded 88 mm-113.14 mm Pitch Spiral |
| Average streamwise velocity (Ux – m/s)) | 172.40 | 174.00 |
| Average in-plane velocity magnitude (Uy Uz – m/s) | 33.57 | 53.80 |
| Ratio of in-plane to streamwise velocity | 0.1947 | 0.3092 |

This ability of tubes of the invention to exhibit a high velocity of the gas in the plane of the tube can explain why when the fin extends across the full length of the tube, the core gas temperature is significantly higher (10° C.) than the tubes of RUN02. This 10° C. difference is maintained for 1.72m, to decrease at 7.1° C. average up to 7.83m length (178×ID) so during 5.71m, to decrease in average to 4.5° C. average from 7.83m length to exit 13.26m (301×ID), so during 5.43m. In other words, when the tube of the invention comprises a continuous fin extending across the full length of the tube, the gas temperature is increased along the full length of the tube, relative to the tubes having a discontinuous fin of fixed helical pitch across the full length of the tube. This performance can be of great advantage when the gas to crack is a heavy feedstock, which are more difficult to crack. Such heavy feedstocks undergo a slower kinetic cracking reaction and so need more time and an increased temperature to reach a better cracking yield.

Tube

Tubes according to the present invention may be prepared by centrifugal casting or by extrusion.

In preferred embodiments, the steel tube is an extruded steel tube.

In embodiments, the fin formed on the inner wall of the tube is a steel fin. The fin may be welded directly to the inner wall of the tube. The fin may be a shaped spring wire that is spot welded to the inner wall of the tube Example 7

Figure 9:
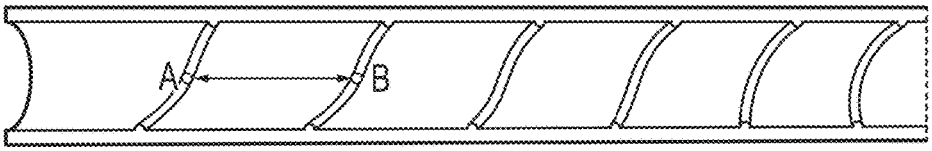
FIG. 9 depicts the internal profile of an exemplary tube according to the present invention.

An exemplary tube according to the present invention, having a variable pitch fin and an internal diameter of 50 mm, is depicted in FIG. 9. The exemplary tube was prepared by centrifugal casting. The fin on the inner wall of the tube was welded using Automatic Tungsten Inert Gas (TIG) welding. This technique uses a filler wire to produce the internal fin profile. The welding parameters were such that the weld profile was semi-circular and has an average height of 2 mm and an average width of 3.5 mm.

Tubes according to the present invention may be prepared from an alloy comprising:

from 0.15 to 0.35 wt % carbon,
from 2.5 to 5.0 wt % aluminium,
from 40 to 45 wt % nickel,
from 25 to 35 wt % chromium,
from 0.50 to 1.50 wt % niobium and/or vanadium,
from 0.01 wt % to 0.25 wt % yttrium,
from 0.01 wt % to 0.25 wt % tungsten and/or tantalum,
from 0.01 wt % to 0.25 wt % in total of one or more of titanium and/or zirconium and/or hafnium,
up to 0.9 wt % manganese,
up to 0.9 wt % silicon, and
up to 0.10 wt % nitrogen,
with the balance of the composition being iron and incidental impurities
optionally wherein between 1 wt % and 75 wt % by weight of the nickel is replaced with cobalt.

Tubes according to the present invention may be prepared from an alloy comprising:

from 0.15 to 0.35 wt % carbon,
from 2.5 to 5.0 wt % aluminium,
from 40 to 45 wt % nickel,
from 25 to 35 wt % chromium,
from 0.50 to 1.50 wt % niobium and/or vanadium,
from 0.01 wt % to 0.05 wt % yttrium,
from 0.05 wt % to 0.25 wt % tungsten and/or tantalum,
from 0.04 wt % to 0.15 wt % in total of one or more of titanium and/or zirconium and/or hafnium,
an amount of up to 0.9 wt % manganese,
an amount of up to 0.6 wt % silicon, and
an amount of up to 0.10 wt % nitrogen,
with the balance of the composition being iron and incidental impurities
optionally wherein between 5 wt % and 15 wt % by weight of the nickel is replaced with cobalt.

Tubes of the invention may be prepared from the above alloys, wherein carbon is present in an amount of from 0.20 wt % to 0.35 wt %.

Tubes of the invention may be prepared from the above alloys, wherein aluminium is present in an amount of from 3.5 wt % to 4.5 wt %.

Tubes of the invention may be prepared from the above alloys, wherein nickel is present in an amount of from 42 wt % to 45 wt %.

Tubes of the invention may be prepared from the above alloys, wherein chromium is present in an amount of from 28 wt % to 30 wt %.

Tubes of the invention may be prepared from the above alloys, wherein niobium is present in an amount of from 0.80 wt % to 1.50 wt %.

Tubes of the invention may be prepared from the above alloys, wherein silicon is present in an amount of from 0.3 wt % to 0.6 wt %.

Tubes of the invention may be prepared from the above alloys, wherein manganese is present in an amount of from 0.4 wt % to 0.8 wt %.

Tubes of the invention may be prepared from the above alloys, wherein tungsten is present in an amount of from 0.05 wt % to 0.15 wt %.

Tubes of the invention may be prepared from the above alloys, wherein titanium is present in an amount of from 0.08 wt % to 0.15 wt %.

Tubes of the invention may be prepared from the above alloys, wherein yttrium is present in an amount of from 0.01 wt % to 0.03 wt %.

Tubes of the invention may be prepared from the above alloys, wherein nitrogen is present in an amount of from 0.03 wt % to 0.06 wt %

Tubes according to the present invention may be prepared from an alloy according to Table 10:

TABLE 10

| | C | Ni | Cr | Nb | Si |
|---|---|---|---|---|---|
| wt % | 0.25 | 43.3 | 29.6 | 0.81 | 0.56 |
| | Mn | W | Ti | Y | Al |
| wt % | 0.54 | 0.05 | 0.11 | 0.01 | 3.86 |

Comparative Example 1

A number of simulations were performed by the methods described herein, to determine the influence of each of the tube parameters on the pressure drop and gas outlet temperature on tubes having a length of 6m and a diameter of 75 mm. Tubes having a diameter of 75 mm fall outside the scope of the present invention and therefore provide a useful comparison of the beneficial properties of the tubes of the invention. The results of these simulations are given in Table 11.

TABLE 11

| | Input Parameters | | | | Outputs | |
|---|---|---|---|---|---|---|
| Run | Initial Pitch | Final Pitch | Initial Length | Final Length | Pressure Drop (bar) | Outlet Temperature (C.) |
| 1 | 292.050 | 217.125 | 1579 | 1684 | 0.2537 | 954.15 |
| 2 | 371.100 | 82.875 | 526 | 421 | 0.2968 | 953.93 |
| 3 | 197.400 | 153.975 | 2000 | 1158 | 0.3147 | 957.27 |
| 4 | 165.750 | 201.300 | 421 | 842 | 0.3058 | 957.45 |
| 5 | 386.850 | 193.425 | 632 | 211 | 0.2401 | 952.83 |
| 6 | 418.350 | 177.600 | 1158 | 1895 | 0.2591 | 953.67 |
| 7 | 450.000 | 114.450 | 1263 | 947 | 0.2740 | 953.15 |
| 8 | 260.550 | 225.000 | 1474 | 526 | 0.2556 | 954.44 |
| 9 | 228.900 | 75.000 | 1368 | 632 | 0.3848 | 958.73 |
| 10 | 244.800 | 122.400 | 211 | 316 | 0.3133 | 956.53 |

TABLE 11-continued

| | Input Parameters | | | | Outputs | |
|---|---|---|---|---|---|---|
| Run | Initial Pitch | Final Pitch | Initial Length | Final Length | Pressure Drop (bar) | Outlet Temperature (C.) |
| 11 | 339.450 | 130.275 | 1684 | 105 | 0.2571 | 953.51 |
| 12 | 150.000 | 169.725 | 947 | 1789 | 0.3750 | 959.81 |
| 13 | 307.950 | 106.575 | 1789 | 1579 | 0.3385 | 955.26 |
| 14 | 355.200 | 98.700 | 737 | 2000 | 0.3519 | 956.55 |
| 15 | 434.250 | 146.025 | 105 | 1053 | 0.2654 | 953.69 |
| 16 | 402.600 | 185.550 | 1895 | 737 | 0.2416 | 952.68 |
| 17 | 323.700 | 209.175 | 316 | 1263 | 0.2527 | 953.99 |
| 18 | 276.300 | 138.150 | 0 | 1368 | 0.3181 | 955.93 |
| 19 | 181.650 | 90.825 | 842 | 1474 | 0.5079 | 966.10 |
| 20 | 213.150 | 161.850 | 1053 | 0 | 0.3206 | 956.75 |
| 22 | 176.330 | 145.743 | 103 | 510 | 0.3502 | 959.55 |
| 23 | 179.202 | 129.635 | 350 | 312 | 0.3695 | 960.70 |

It can be seen from the above results that larger diameter pipes, such as those over 70 mm, do not obey the same rules as the pipes of the invention. The experimental results appear to show that that pipes having diameters larger than 70 mm, i.e. those falling outside the scope of the present invention, are less affected by the profile of the internal fin. In other words, the gas flow appears to be less affected by the fin in these pipes.

As evident from Table 11, tubes having a diameter of 75 mm do not provide the same beneficial temperature and pressure drop properties. In addition, the relative effects of the initial and final helical portions on the overall properties, i.e. temperature and pressure of the fluid stream within the pipe, appear to be different from the pipes of the invention. This is evident from at least RUN9, RUN12, RUN19, RUN22, and RUN23, which demonstrate that tubes having an initial region of constant helical pitch with a higher pitch than the pitch in the final region of constant helical pitch result in higher outlet temperatures. This is the complete opposite to tubes according to the invention, where a lower pitch in the initial region of constant helical pitch than in the final region of constant helical pitch gives the highest outlet temperatures. As can be seen from RUN4, 75 mm diameter tubes having a lower pitch in the initial region of constant helical pitch results in a lower outlet temperature.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A steel tube for use in cracking hydrocarbons at high temperature, wherein the steel tube has a fin formed on the inner wall of the tube, the fin extending continuously in a helical direction across at least a portion of an axial length of the tube, wherein the fin comprises:

an initial region of constant helical pitch, an intermediary region of varying helical pitch that extends for at least three helical rotations of the fin, wherein a pitch of the fin in the intermediary region of varying helical pitch increases from its beginning to its end, and a final region of constant helical pitch.

2. The steel tube of claim 1, wherein the fin extends for an entire axial length of the tube.

3. The steel tube of claim 1, wherein the initial region of constant helical pitch is between 1 D and 40 D in length (where D is an internal diameter of the tube).

4. The steel tube of claim 1, wherein the final region of constant helical pitch is between 1 D and 40 D in length (where D is an internal diameter of the tube).

5. The steel tube of claim 1, wherein the intermediary region of variable helical pitch is a length that is at least 80% of the axial length of the tube.

6. The steel tube of claim 1, wherein the intermediary region of variable helical pitch is a length that is at least 50% of the axial length of the tube.

7. The steel tube of claim 1, wherein the pitch increases at a constant rate along the axial length of the intermediary region of varying helical pitch.

8. The steel tube of claim 1, wherein a cross-sectional profile of the inner wall of the tube is circular in shape.

9. The steel tube of claim 1, wherein a height of the fin is approximately constant along its axial length.

10. The steel tube of claim 1, wherein the tube has an internal diameter in the range of 20 mm to 100 mm.

11. The steel tube of claim 1, wherein the tube has an internal diameter in the range of 20 mm to 70 mm.

12. The steel tube of claim 1, wherein a cross-section of the fin is semi-circular.

13. The steel tube of claim 1, wherein the overall change in helical pitch from the beginning of the intermediary region to the end of the intermediary region is greater than 0.2 D, where D is the internal diameter of the tube.

14. The steel tube of claim 1, wherein the fin is a first fin, and wherein the steel tube includes a second fin that at least partially overlaps with the first fin.

* * * * *